United States Patent [19]

O'Hanlon

[11] Patent Number: 4,540,056

[45] Date of Patent: Sep. 10, 1985

[54] CUTTER ASSEMBLY

[75] Inventor: Thomas A. O'Hanlon, Tacoma, Wash.

[73] Assignees: Inco Limited; Falconbridge Limited; Noranda, Inc.; Kidd Creek Mines Limited, all of Toronto, Canada; Flow Industries, Inc., Kent, Wash.

[21] Appl. No.: 607,017

[22] Filed: May 3, 1984

[51] Int. Cl.[3] ..... E21B 10/62; E21B 10/64

[52] U.S. Cl. ..... 175/393; 175/410

[58] Field of Search ..... 175/393, 381, 422, 327, 175/385, 386, 382, 339, 340, 342, 410; 299/81

[56] References Cited

U.S. PATENT DOCUMENTS

| | | | |
|---|---|---|---|
| 554,968 | 2/1896 | Wyant | 175/385 |
| 1,774,522 | 9/1930 | Phipps | 175/381 |
| 2,884,227 | 4/1959 | Hjalsten | 175/393 |
| 3,112,803 | 12/1963 | Rowley | 175/393 |
| 3,382,940 | 5/1968 | Stebley | 175/410 |
| 3,688,852 | 9/1972 | Gaylord et al. | 175/393 |
| 3,952,819 | 4/1976 | Adcock | 175/410 X |
| 4,190,125 | 2/1980 | Emmerich et al. | 175/410 |
| 4,406,336 | 9/1983 | Olsen et al. | 175/410 |

OTHER PUBLICATIONS

Development of a System for High Speed Drilling of Small Diameter Roof Bolt Holes—Final Report, Earth Mechanics Institute, Colorado School of Mines, U.S.-D.O.E. Contract No. DE-AC01-76ET-12462, Apr. 1982.

*Primary Examiner*—Stephen J. Novosad
*Assistant Examiner*—Thuy M. Bui
*Attorney, Agent, or Firm*—Edward A. Steen; Raymond J. Kenny

[57] ABSTRACT

A drill bit with multiple fluid jet cutting nozzles designed so that the drill bit workface including the cutters is a separate piece from the drill bit body that houses the fluid jet nozzle orifice mounts. The cutter assembly protects the nozzle housing from rapid wear and it can be easily removed from the nozzle housing without disturbing or removing any of the nozzle orifice mounts.

4 Claims, 2 Drawing Figures

CUTTER ASSEMBLY

TECHNICAL FIELD

The instant invention broadly relates to drilling in general and more particularly to cutting bits for effecting drilling.

BACKGROUND ART

The drilling of boreholes in rock, ore, coal and concrete (hereinafter "rock"), is a task performed during the course of operations common to the mining, construction and petroleum industries. Typical uses for boreholes include placement of explosives, placement of rock support pins and tapping deposits of natural gas and petroleum. Typical drilling machines produce boreholes in rock by pushing an elongated hollow tool stem (drill rod, drill steel, drill pipe) having a workface with hardened cutters (drill bit) against the rock while applying rotating and/or impacting forces to the drill bit. The cutter edges on the drill bit break particles of rock and scrape them away, enabling the drill bit to advance progressively into the rock, creating a borehole. The rock particles are normally flushed away from the workface and out of the borehole around the advancing drill rod by means of a fluid (usually water) pumped through the drill rod and emitted near the workface through fluid passages in the drill bit. The velocity of the fluid exiting through the drill bit passages is normally less than 800 feet per second (244 m/sec) and the passages normally have a diameter greater than 0.100 inch (2.54 mm). Rapid dulling of the drill bit cutter edges occurs because of the abrasiveness of the rock and the severe mechanical stress transmitted through the cutter edges into the rock. Dulling of the cutter edges substantially reduces the rate at which the borehole is advanced. As a result, many drill rods use detachable drill bits that can be easily removed from the drill rod. This makes it practical for the drilling machine operator to have a plurality of drill bits available at the work site, where they can be quickly replaced when dull and resharpened at the convenience of the operator without delaying the drilling operation.

A typical drill bit assembly consists of a short body with means of attaching it to the drill rod. The assembly further includes fluid passages which are connected to fluid passage of the drill rod. The cutters on the workface are usually constructed of hardened steel, tungsten carbide, diamond or other similarly wear resistant materials. When wear limits are reached, the entire drill bit assembly is normally scrapped.

Extensive laboratory and field tests have demonstrated that borehole drilling advance rates can be substantially improved if the drill bit cutters are assisted by high-velocity fluid cutting jets. These jets are created by increasing the fluid pressure inside the drill rod in conjunction with installing special fluid passage orifices (nozzles) in the drill bit. These nozzles create concentrated fluid streams (jets) that are directed at the borehole workface, cutting into it while it is simultaneously being attacked by the drill bit cutters. Fluid jet cutting makes it easier for the drill bit cutters to break the rock, thus increasing the borehole advance rate while reducing the rate of cutter wear. In order to achieve sufficient jet velocity to enable cutting of the rock workface, differential pressure across the nozzles in the drill bit will range from about 5,000 to 60,000 lbs./in$^2$ (34.5 MPa–413.7 MPa) or higher depending on the hardness and type of rock encountered. Jet velocities must normally exceed about 800 feet per second and the fluid passage orifice (nozzle) diameters will normally be less than about 0.060 inches (1.5 mm), with nozzles as small as about 0.003 inch (0.07 mm) diameter sometimes used.

In order to obtain full advantage of the beneficial effects of fluid jet cutting assistance, it is often necessary to mount a plurality of nozzle orifices in a single drill bit, with the nozzles aimed at different portions of the borehole workface. By way of non-limiting example, it has been found beneficial to have four nozzle orifices in a drill bit for 1.0 inch (2.54 cm) diameter boreholes. Larger diameter holes require progressively larger numbers of nozzle orifices.

The necessity to machine multiple fluid passages and nozzle mounts into the drill bit body causes a substantial increase in the cost of manufacturing the drill bit. When wear limits are reached on the outer workface of the drill bit, the fluid passages are still servicable. However, the expensive assembly must be scrapped, as the fluid passages are integral with the bit workface.

Several attempts have been made to solve the wear problem, most of which fall into the catagories of either (a) improving the wear resistance of a single piece drill bit cutter/nozzle assembly, or (b) separating the cutter assembly from the nozzle housing. Regarding improving the wear resistance of a single piece cutter/nozzle assembly, only limited success has been achieved. Cutter life has been improved by increasing the number of cutting jets per unit of borehole diameter and by using special hardened cutter inserts protected with diamond covered surfaces. However, the total cost per increment of borehole length is still high because the drill bit body tends to wear rapidly from the erosive slurry rebound that results when high-velocity fluid jets strike abrasive rock surfaces. Many harder materials that can resist jet rebound erosion are not metalurgically or structurally compatable with high-pressure fluid passages and nozzle mounts.

Separation of the cutter assembly from the nozzle body has been previously accomplished in a number of different ways. All of the known previous attempts share three major shortcomings that clearly distinguish them from the inventive concept described and claimed herein.

In some of the prior attempts, the nozzle housings and cutter assemblies are attached together in such a way that a dull cutter assembly cannot be removed without loosening or removing the nozzle housing. This presents the opportunity for dirt particles to enter the fluid supply passages and clog the small orifices necessary to create the fluid cutting jets. Experience has shown that accidental contamination of fluid passages causing plugging of nozzle orifices is one of the most common problems with fluid jet apparatus. The disclosed concept allows the cutter assembly to be quickly removed without loosening any fluid passage connection or allowing the possibility of dirt entering the fluid passages.

Most of the prior attempts utilize a cutter assembly with a large hole(s) through which one or more jets pass. As a result, a significant portion of the nozzle housing is exposed to rapid wear from jet rebound erosion and erosion from rotating the nozzle housing while it is immersed in the rock particle slurry flowing away from the workface of the borehole. The disclosed concept has each individual jet emitted through comparatively small holes in the cutter assembly whereby the nozzle housing is completely protected from jet rebound erosion. Additionally, the cutter assembly protects the sides of the nozzle housing so that wear caused by the rock particle slurry is greatly reduced.

Some of the prior attempts use small nozzle housings that must be located at the center of the cutter assembly. As borehole diameter increases, the fluid cutting jets must travel progressively longer distances to reach the outer portions of the borehole workface. This greatly reduces cutting efficiency, due to the tendency of fluid jets to decay within a short distance of the nozzle orifice when emitted into the slurry environment present at the workface of a borehole. Additionally, the geometry of the nozzle housings limit the quantity of cutting jets that can fit into the housing. These factors make the previous attempts very inefficient for larger diameter boreholes. The disclosed concept uses multiple nozzle orifices located at a uniformly close proximity to the borehole workface all across the workface diameter, enabling much better fluid jet cutting efficiency in larger diameter boreholes.

SUMMARY OF THE INVENTION

There is provided a drill bit with multiple fluid jet cutting nozzles designed so that the drill bit workface including the cutters is a separate piece from the drill bit body that houses the fluid jet nozzle orifice mounts. Herein-after the separate workface piece will be referred to as a "cutter assembly" and the drill bit body with fluid passages and orifice mounts will be referred to as a "nozzle housing". The cutter assembly protects the nozzle housing from rapid wear and it can be easily removed from the nozzle housing without disturbing or removing any of the nozzle orifice mounts. The cutter assembly is tightly secured to the nozzle housing by means of threaded member extending there-between. The cutters are resharpenable if desired and the cutter assembly can be scrapped after wear limits are reached, without the need to remove or scrap the nozzle housing. The servicable life of the nozzle housing is greatly extended, thereby substantially reducing the cost of drilling boreholes with fluid jet cutting assist.

PREFERRED MODE FOR CARRYING OUT THE INVENTION

Figure 1:
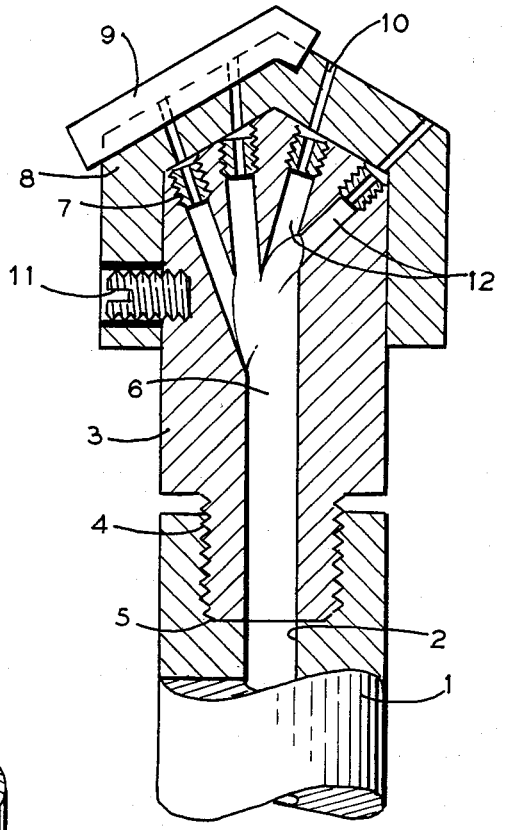
FIG. 1 is a cross-sectional elevation of an embodiment of the invention.
Figure 2:
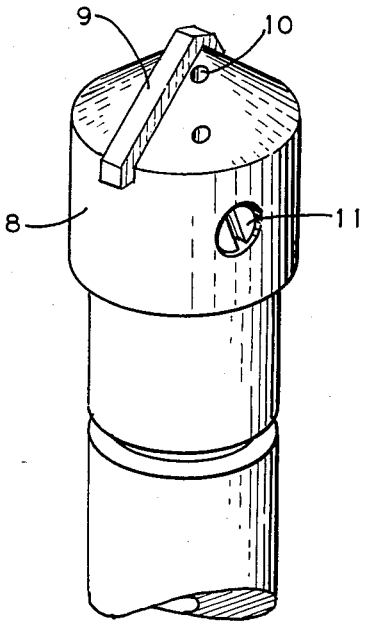
FIG. 2 is a perspective view of an embodiment of the invention.

Referring to FIGS. 1 and 2, it may be observed that only the end of a drill rod 1, nozzle housing 3, and cutter assembly 8 are illustrated, as the embodiment of a borehole drilling machine using fluid cutting jets is well known and need not be described here.

The drill rod 1 is attached to a suitable device able to rotate the drill rod 1 or rotate and impact the drill rod 1 while thrusting axially against the drill rod 1 in the intended direction for advancing the borehole. Fluid passage 2 in the drill rod 1 is connected to a fluid pumping source (not shown) via a rotatable fluid supply swivel connection (not shown) that enables fluid from the pump to enter the passage 2 in the rotating drill rod 1. Nozzle housing 3 includes drill rod attachment means 4 with fluid passage sealing connection 5 enabling nozzle housing fluid passage 6 to connect with the drill rod fluid passage 2 without any fluid leakage. The nozzle housing fluid passage 6 has a plurality of branches 12 supplying fluid to the nozzle orifice mounts 7 which are located near the surface of the nozzle housing 3 that is nearest the borehole workface.

The cutter assembly 8 includes one or more hardened cutter edges 9, and a plurality of small passages 10 through which the fluid jets are emitted after exiting the nozzle orifices 7. Each passage 10 is placed so as to be concentrically aligned with a corresponding nozzle orifice 7. The cutter assembly 8 is attached to and aligned with the nozzle housing 3 by securing means 11, which is designed to withstand torsional and thrusting forces that could cause mis-alignment of the passages 10 with the nozzle orifices 7 or cause accidental detachment of the cutter assembly 8. The securing means 11, in the illustrated embodiment, is a recessed set screw traversing the cutter assembly 8 and theadedly extending into the nozzle housing 3.

The hardened cutter edges 9 extend laterally beyond the sides of cutter assembly 8 a sufficient distance to allow clearance for rock chips and slurry to flow away from the borehole workface.

By way of a non-limiting example, when the cutting assembly 8 is being utilized for relatively small boreholes (having less than about a 3 inch [76.2 mm] diameter), the diameter of the fluid passage 10 may range from about 2 times to diameter of the orifice 7 to a maximum of about 0.100 inch (2.5 mm).

It may be appreciated that the disclosed invention may be applied to borehole drilling in the mining construction and petroleum industries. Moreover, the bit may be used with high pressure industrial cleaning, scarification of concrete, cutting deep wide slots in rock and concrete, and as a cutter face for directional drills employed by utilities and coal industries.

In summary, there is disclosed and claimed a cutting unit for fluid jet assisted borehole drilling that serves to protect the nozzle housing from rapid wear and:

(1) can be easily and quickly removed from the nozzle housing without loosening or disturbing any of the nozzle orifice mounts;

(2) allows a plurality of fluid jet nozzles to be mounted without exposing the nozzle housing to erosive wear from fluid jet rebound or slurry flow around the cutter assembly;

(3) can be quickly attached to the nozzle housing without problems of alignment between the fluid jet orifice mounts and the small fluid jet exit holes in the cutter assembly; and (4) allows a plurality of fluid jets to be aimed near the outer diameter of larger borehole workfaces without substantially increasing the separation distance of the nozzle orifices from the workface as compared to nozzles aimed at the center portion of the borehole workface, making fluid jet cutting assist practical for large diameter boreholes.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A high pressure, non-percussive fluid jet cutting drill bit, the bit comprising a housing, the housing including a cylindrical body having a peaked proximal section and a distal section adapted to threadingly engage a drill rod, a fluid passage extending through the body, a plurality of branches communicating with the fluid passage and extending without the peaked proximal section, a complimentary cup-like cutter assembly demountably enveloping the peaked proximal section and extending towards the distal section, the cup-like cutter assembly having a peaked work face and a plurality of apertures, a plurality of nozzles disposed in the branches and adjacent to the apertures, the common contacting surfaces of the cup-like cutter assembly and cylindrical body in tight non-threaded registry, a cutter affixed to the cup-like cutter assembly, and a securing member extending through the side of the cup-like cutter assembly and into the side of the housing so as to secure the cup-like cutter assembly to the housing and to maintain a concentric alignment of passage, nozzle and aperture.

2. The bit according to claim 1 wherein the securing member is threaded and recessed in the cup-like cutter assembly.

3. The bit according to claim 1 wherein the cutter is a band extending from the side of the cutting assembly to slightly past the peak of the workface.

4. The bit according to claim 1 wherein the diameter of the passage ranges from about two times the diameter of the nozzle to about 0.10 inch (0.25 cm).

* * * * *